United States Patent [19]

Kleinhans

[11] Patent Number: 4,813,621

[45] Date of Patent: Mar. 21, 1989

[54] REFINER FOR PROCESSING FIBER MATERIAL

[75] Inventor: Siegfried Kleinhans, Berlin, Fed. Rep. of Germany

[73] Assignee: Siemens Aktiengesellschaft, Berlin & Munich, Fed. Rep. of Germany

[21] Appl. No.: 84,927

[22] Filed: Aug. 12, 1987

[30] Foreign Application Priority Data

Aug. 20, 1986 [DE] Fed. Rep. of Germany ..... 3628195

[51] Int. Cl.[4] ..... B02C 7/12

[52] U.S. Cl. ..... 241/261.2; 241/298

[58] Field of Search ..... 241/261.2, 261.3, 28, 241/296, 297, 298

[56] References Cited

U.S. PATENT DOCUMENTS

| | | | |
|---|---|---|---|
| 25,243 | 8/1859 | Brevoort | 241/298 |
| 406,954 | 7/1889 | Potter | 241/298 |
| 992,000 | 5/1911 | Kihlgren | 241/261.2 |
| 1,778,860 | 10/1930 | Lindenfelser | 241/298 |
| 3,910,511 | 10/1975 | Leider et al. . | |
| 4,351,489 | 9/1982 | Laptev et al. . | |

FOREIGN PATENT DOCUMENTS

| | | |
|---|---|---|
| 2522349 | 12/1975 | Fed. Rep. of Germany . |
| 2724161 | 11/1978 | Fed. Rep. of Germany . |

*Primary Examiner*—Mark Rosenbaum
*Attorney, Agent, or Firm*—Kenyon & Kenyon

[57] ABSTRACT

The grinding discs of a refiner driven by an electric motor carry on the end faces facing each other material-grinding barriers or cutters which are arranged in groups in sectors and extend parallel to each other. To reduce the torsional excitation of the rotor shaft of the electric motor occurring during the operation of the refiner as far as possible, the sectors have irregular pitch or different sector angles along the circumference of the grinding discs.

3 Claims, 2 Drawing Sheets

REFINER FOR PROCESSING FIBER MATERIAL

BACKGROUND OF THE INVENTION

The present invention relates to a refiner for processing fiber material, consisting of two oppositely arranged grinding discs which are driven by an electric motor and of which the end faces facing each other comprise processing devices with material grinding barriers and cutters, respectively, which are arranged in groups along the circumference of the grinding discs in sectors extending parallel to each other and interposed flow canals.

Such refiners are known, for instance, from DE-OS No. 25 22 349 (U.S. Pat. No. 3,910,511), U.S. Pat.No. 4,351,489 and DE-OS No. 27 24 161. The refiners serve for comminuting raw material, for instance, wood chips, by means of rotating processing devices which are arranged on the oppositely disposed end faces of grinding discs. These grinding discs are driven by electric motors in that either only one grinding disc rotates and is set against a stationary disc, or two grinding discs rotating in opposite directions of rotation are moved against each other, and are driven by a separate electric motor each. The material to be comminuted is fed to the space between the two grinding discs, runs through them generally radially from the inside out and leaves the refiner as a paste.

The processing devices of the known grinding discs with the mutually parallel extending material grinding barrier or cutter groups and flow canals located in between are arranged interchangeably on sectors of the grinding disc. These sectors all have the same size. The cutters supported by them have a uniform arrangement in the groups; they generally make an angle with the radius. The geometric arrangement of the processing devices depends on the raw material to be processed. A subdivision of the sectors into two or more radially successive ring sectors with a different arrangement of the material grinding barriers or cutters is known.

Depending on the output of the refiner, the latter and the driving electric motor are equipped with bearings of their own and, in the case of large ratings, are connected to each other via flexible but rotation-rigid couplers. In the case of smaller ratings, the grinding discs of the refiner and the rotor of the driving motor are arranged on a common shaft. The operation of the refiner subjects the driving electric motor to heavy stresses which can have vibration problems as a consequence and resulting therefrom, also damage. It is therefore customary to overdesign the parts of the refiner and in particular, also the mounting parts of the rotors of the drive motors, in order to prevent damage.

SUMMARY OF THE INVENTION

It is an object of the present invention to reduce the costs incurred by such overdesign without increasing the damage-proneness in refiner arrangements with driving electric motors.

The above and other objects of the invention are achieved by a refiner for processing fiber material, comprising two oppositely arranged grinding discs which are driven by an electric motor and of which the end faces facing each other have processing devices with material grinding barriers or cutters which are arranged along the circumference of the grinding discs by groups in sectors and extend parallel to each other and flow canals located in between, wherein the sectors with the material grinding barrier or cutter groups have an irregular pitch or different sector angles along the circumference of the grinding discs.

By this nonuniform pitch of the sectors with the processing devices of the grinding disc, the geometric arrangement of which depends on the material to be ground, the frequencies for the rotary-vibration system of the refiner, namely, the rotary-vibration system "grinding disc-drive motor" excited by the processing devices, are influenced, since torque excitations resulting from the grinding process now act on sectors of different sizes which accordingly have different number of material-grinding barriers or cutters. Thereby, the excitations for torsional vibrations are reduced. In addition, also the excited frequency can be influenced by the distribution of the differently-sized sectors, so that it can be placed in regions outside of the torsional resonance frequency of the system. This reduces the danger that resonances might occur.

In order further to obtain optimum statistical distribution of the sizes of the sectors and thereby optimally small excitations, each grinding disc is advantageously subdivided into at least two equal or nearly equal regions with the same number of sectors, and in each region, the sector angles of the successive sectors deviate heavily from each other and are different without repetition from region to region.

The influencing of the exciting torques is independent of the geometric arrangement which the processing devices in the sectors have. Each sector can also be subdivided into two or more readily succeeding ring sectors with different arrangement of the material-grinding barriers or cutters.

BRIEF DESCRIPTION OF THE DRAWINGS

The invention will be explained in greater detail in the following detailed description with reference to the embodiment shown in FIGS. 2 and 3 of the drawings in which.

DETAILED DESCRIPTION

Figure 1:
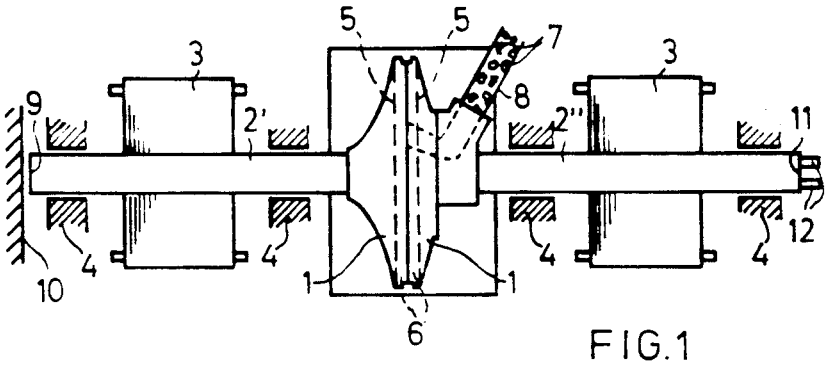
FIG. 1 shows schematically a longitudinal section through a refiner.

FIG. 1 of the drawing shows the design in principle of a refiner with two grinding discs 1 rotating against each other, which are located on the rotor shaft 2', 2'' of respective electric motors 3 of synchronous or asynchronous design, of which only the rotor is shown. Each rotor shaft 2 is supported in two sliding bearings 4 in such a manner that a certain amount of axial mobility of the rotor shafts 2', 2'' is possible. This is necessary because the processing devices 6 located on the end faces 5 of the grinding discs 1 facing each other wear out during the operation of the refiner and also must therefore be replaced at certain time intervals.

The raw material 7 to be processed by the refiner, for instance, wood chips, is fed to the space between the two grinding discs 1 radially inward by means of a feedpipe 8. So that during the processing of the raw material 7 the desired processing distance and the desired axial pressure can be exerted between the counter-rotating grinding discs, a counter-bearing 10 indicated only schematically as a surface is provided for the shaft end 9 of the rotor shaft 2' facing away from the grinding disc 1, while a hydraulic setting device 12, only indicated schematically, acts on the corresponding shaft end 11 of the rotor shaft 2'', whereby the desired operating conditions are established.

Figure 2:
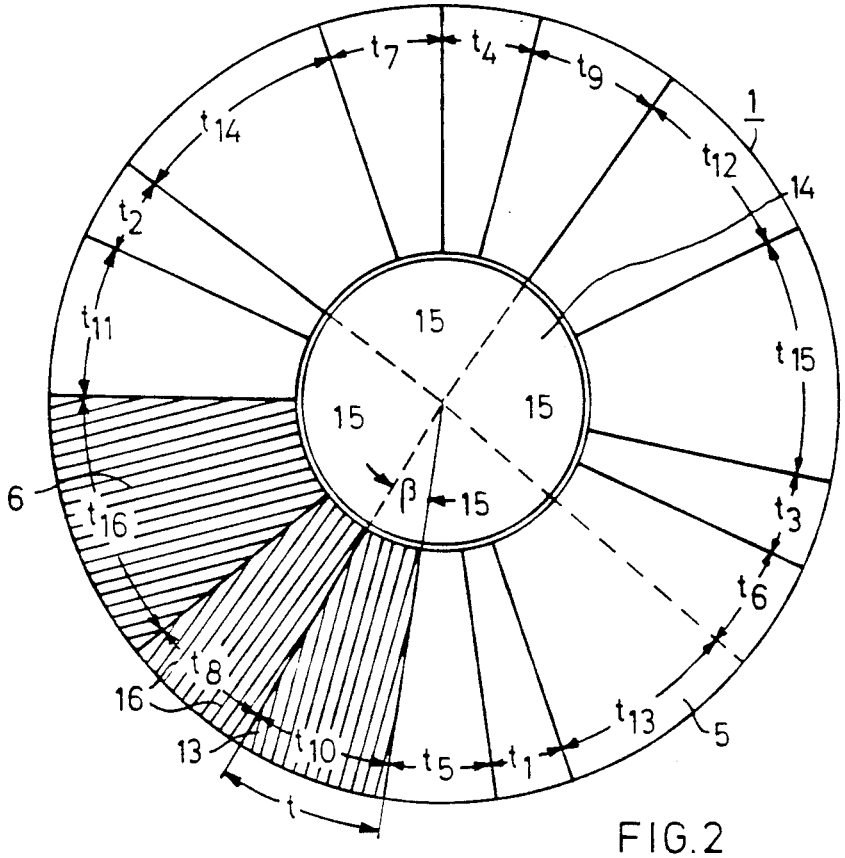
FIG. 2 and 3 are a view of an end face of the grinding disc of such a refiner.

In FIG. 2, a view of the end face 5 of a grinding disc 1 is shown, which is designed in accordance with the invention. The processing devices 6 are located on sectors 13 which are fastened exchangeably in a suitable manner, not shown, to the end face 5 of the grinding disc 1. The sectors 13 which follow each other along the circumference of the grinding disc 1 which has a central opening 14, have a nonuniform pitch t or sector angles of different size B, so that the sectors 13 therefor have different sizes.

Since the grinding disc 1 is provided with a total of sixteen sectors 13, a sequence of sixteen different pitches $t_1$ to $t_{16}$ has been chosen, the sum of which makes a circular disc and of which the pitch $t_{16}$ is the largest and $t_1$ the smallest. Correspondingly, there are likewise sixteen different sector angles B, the total of which makes a sum of 360°.

In addition, an irregular distribution of the sectors 13 of different sizes on the grinding disc 1 is desirable. To achieve this, the grinding disc 1 has been subdivided into four almost equal regions 15 which are bounded in FIG. 2 by dashed lines. In each of these regions 15, four sectors 13 are accommodated. To this end, four pitches are picked out for each region from the sequence of different pitches which, as far as possible, do not follow each other directly in the sequence of pitches ordered by size and, which when added, correspond to the pitch of each region 15. These four pitches t of each region 15 are then further permutated with each other, so that the sequence of the numerical values of the pitches t along the circumference of the grinding disc 1 deviates as far as possible from the sequence of the pitches t ordered by size and are different from region 15 to region 15 without repetition. Thereby, a distribution of the sectors 13 of different size is obtained which results in a torque excitation as small as possible.

Each sector 13 carries the processing device 6 consisting of cutters 16 which are arranged parallel to each other. The geometric arrangement and the angle to the radius of these cutters 16 are chosen so that they best meet the desired processing of the raw material 7.

Figure 3:
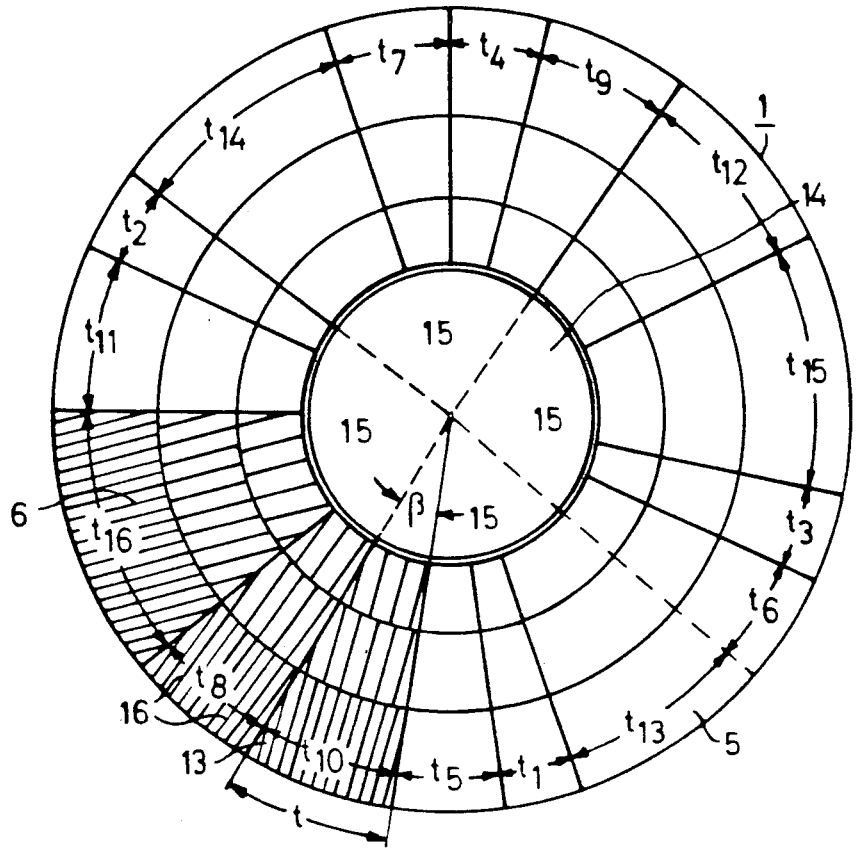

In FIG. 3 a view of the end face 5 of a grinding disc 1 is shown, which sectors 13 have a nonuniform pitch t or sector angles of different size B like shown in FIG. 2. Each sector 13 is radially subdivided into three succeeding ring sectors with different arrangement of the processing devices 6, which are material-grinding barriers of cutters.

In the foregoing specification, the invention has been described with reference to exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a respective sense.

What is claimed is:

1. A refiner for processing fiber material, comprising two oppositely arranged grinding discs at least one of which is driven by an electric motor, the grinding discs each having circumferential directions and end faces facing each other having material grinding or cutting processing means arranged in the circumferential direction of the grinding discs by groups in sectors, each sector having a sector angle, the processing means in each sector extending parallel to each other and having flow canals located in between the processing means, each of the sectors having said processing means having a different pitch or different sector angle in the circumferential direction of the grinding discs than any of the other sectors.

2. The refiner recited in claim 1, wherein each grinding disc is subdivided into at least two equal or nearly equal regions with the same number of sectors and in each region the sector angles of the successive sectors or pitches deviate substantially from each other and are different from region to region without repetition.

3. The refiner recited in claim 1, wherein each sector is subdivided into two or more ring sectors successive to each other radially with a different arrangement of the material-grinding barriers or cutters.

* * * * *